US005614684A

United States Patent [19]

Lim et al.

[11] Patent Number: 5,614,684

[45] Date of Patent: Mar. 25, 1997

[54] SUPERPLASTIC MG-BASED COMPOSITE MATERIAL AND METHOD FOR PRODUCTION THEREOF

[75] Inventors: Suk-Won Lim; Tsunemichi Imai, both of Nagoya; Yoshinori Nishida, Kasugai; Takao Choh, Nagoya, all of Japan

[73] Assignee: Agency of Industrial Science and Technology, Ministry of International Trade & Industry, Tokyo, Japan

[21] Appl. No.: 538,437

[22] Filed: Oct. 3, 1995

[30] Foreign Application Priority Data

Oct. 5, 1994 [JP] Japan ..... 6-268389

[51] Int. Cl.[6] ..... C22C 1/10

[52] U.S. Cl. ..... 75/236; 75/244; 75/249; 419/12; 419/13; 419/14; 419/50

[58] Field of Search ..... 75/249, 236, 244; 419/50, 12–14

[56] References Cited

U.S. PATENT DOCUMENTS

| | | | |
|---|---|---|---|
| 4,749,545 | 6/1988 | Begg et al. | 419/13 |
| 5,006,417 | 4/1991 | Jackson et al. | 428/614 |
| 5,256,183 | 10/1993 | Ruch | 75/230 |

OTHER PUBLICATIONS

Materials Letters, vol. 15, No. 4, "Tension Versus Compression Superplastic Behavior Of A Mg9 wt% Li–5 wt% $B_4C$ Composite", J. Wolfenstine, et al. 1992, pp. 305–308.

Materials Letters, vol. 10, No. 7,8, "Microstructural Evolution During Superplastic Flow Of A Binary Mg–8.5 wt% Li Alloy", K. Higashi, et al. Jan. 1991, pp. 134–137.

"High Strain Rate Superplasticity In Mg–Li–Alloys", K. Higashi, et al. pp. 72–79.

J. Japan Inst. Metals, vol. 56, No. 7, "High Temperature Deformation Of SiC Whisker/ AZ91 Magnesium Alloy and SiC Whisker/2324 Aluminum Alloy Composites", J. Kim, et al. (1992) pp. 158–167.

Materia Japan, vol. 34, No. 8, "Superplasticity Of Material", K. Higashi, (1995) pp. 1002–1009.

Netsushori, vol. 30, No. 3, "Superplasticity Of Ceramics And Intermetallic Compounds", Y. Machara, et al. (1990) pp. 299–307.

Light Metal, vol. 42, No. 3, "Microstructural Change During Superplastic Deformation Of The Mg–8 Mass%Li Alloy", W. Fujitani, et al. (1991) pp. 20–27.

*Primary Examiner*—Ngoclan Mai

*Attorney, Agent, or Firm*—Oblon, Spivak, McClelland, Maier & Neustadt, P.C.

[57] ABSTRACT

A method for the production of a superplastic Mg-based composite material comprises preparing a composite material consisting of ceramic particles formed of at least one compound selected from among TiC, AlN, $Si_3N_4$, and $TiB_2$ and a matrix formed of a magnesium alloy, dispersing the ceramic particles in the matrix, hot extruding the composite material, and then hot rolling the resultant extrudate; and a superplastic Mg-based composite material produced by the method.

2 Claims, 2 Drawing Sheets

SUPERPLASTIC MG-BASED COMPOSITE MATERIAL AND METHOD FOR PRODUCTION THEREOF

BACKGROUND OF THE INVENTION

1. Field of the Invention

This invention relates to a superplastic Mg-based composite material reinforced with titanium carbide particles, aluminum nitride particles, silicon nitride whiskers or particles, and titanium boride particles and a method for the production thereof.

2. Description of the Prior Art

Magnesium alloys are the lightest and the highest in strength per unit volume among all practical metallic materials. Like aluminum, they have melting points around 650° C. Magnesium-based composite materials reinforced with ceramic whiskers or particles excel aluminum composite materials in terms of specific strength and specific modulus of elasticity and are excellent in abrasion resistance, dimensional stability at elevated temperatures, and thermal conductivity. Moreover, magnesium alloys are capable of absorbing vibration. Thus, magnesium-based composite materials are expected to find utility in structures and mechanical components in the aerospace industry and the field of transportation equipment.

Particularly when utilized in the aerospace industry, these composite materials have to be press formed into three-dimensional structures, most of which have complicated shapes and large surface areas. It is, therefore, necessary that the composite material be capable of being rolled into a thin plate, the resultant thin plate be capable of being pressed into a desired shape, and the formed article consequently obtained exhibit better material quality than the material prior to undergoing the formation. For meeting this need, attempts are being made to endow magnesium-based composite materials with superplasticity.

The heretofore developed composite materials reinforced with superplastic ceramic whiskers or particles use a matrix of aluminum. Examples of well-known superplastic magnesium alloys include such Mg-Li type alloys as Mg-9% Li alloy and Mg-8.5% Li alloy (G. Gonzalez-Doncel, D. A. Ruans, J. Wolfenstine and O. D. Sherby: Materials Science and Engineering, 125A (1990) 195 p and K. Higashi and J. Wolfenstine, Materials Letters, IO-⅛ (1991) 134/137 p). These alloys are reported to have matrix crystal grain diameters in the range of from 6 to 35 μm and exhibit a maximum total elongation in the range of from 460 to 600% at a strain rate in the approximate range of from 3 to $4\times10^{-3}S^{-1}$ at a temperature in the range of from 453 to 623K. These superplastic properties are practically equal to those of the conventional superplastic aluminum alloys and fall short of satisfying the conditions for a high-speed superplastic material.

As magnesium composite materials reinforced with ceramic whiskers or particles, magnesium-based composite materials reinforced using SiC whiskers or particles are known to the art (Jun Sun Kim, Junichi Kaneko, and Makoto Sugamata: J. Japan Inst. Metals, 56-7 (1992) 819/827 p). Methods available for the production of these magnesium-based composite materials include the forging cast, the melt stirring and mixing (vortex) method, the compocasting method, the powder metallurgy method, and the foil metallurgy method.

A process has been studied for superplasticizing a magnesium-based composite material by using the forging cast to manufacture a magnesium composite material reinforced with SiC whiskers and extrusion forming the composite material in a prescribed shape (J. Japan Inst. Metals, 56-7 (1992) 819/827 p). The composite material obtained by the process, however, does not attain as a large elongation as expected, probably because of high reactivity between SiC and Mg. No magnesium-based composite material using a ceramic substance other than SiC as a reinforcing material has been reported to achieve superplasticity.

In the development of a method for the production of a Mg-based composite material, it is necessary to ascertain the optimum process in light of the properties of Mg.

The powder metallurgy method, for example, is not practicable because magnesium powder is explosive and highly dangerous to handle. The casting method has to be carried out in the ambience of an inert gas because a molten magnesium alloy is susceptible of oxidation. In the course of stirring the alloy melt in this method, it is not easy to thoroughly mix the reinforcing material with the melt in the form of a fine powder of a particle diameter of about 1 μm. Further, since the melt being stirred extrains ambient gas, the produced composite material is apt to include numerous defects. Magnesium-based composite material produced by the casting method has therefore been regarded as inferior. The stirring and mixing method, however, proves most suitable for the production of commercial machine parts because it allows composite materials to be manufactured in large quantities at a low cost.

At present, superplastic Mg-containing composite materials having varying properties are in demand from the practical point of view. The present inventors pursued a study with the object of meeting this demand. This invention has been accomplished as a result.

SUMMARY OF THE INVENTION

To achieve the object mentioned above, this invention provides a method for the production of a superplastic Mg-based composite material which comprises preparing a composite material consisting of ceramic particles formed of at least one compound selected from among TiC, AlN, $Si_3N_4$, and $TiB_2$ and having a maximum particle diameter of 15 μm and a matrix formed of a magnesium alloy containing at least one element selected from among Al, Zn, Zr, and Li in an amount in the range of from 2 to 15% by weight, the ceramic particles being dispersed in the matrix in the range of from 5 to 40% by volume based on the total volume of the composite material, keeping the composite material at a temperature in the range of from 200° to 500° C. and meanwhile extruding the heated composite material at an extrusion ratio of at least 10:1, and then keeping the resultant extrudate at a temperature in the range of from 250° to 550° C. and meanwhile rolling the heated extrudate at a distortion rate in the range of from 1.0 to 4.0, and also provides a superplastic Mg-based composite material produced by the method mentioned above.

DESCRIPTION OF THE PREFERRED EMBODIMENTS

Figure 1:
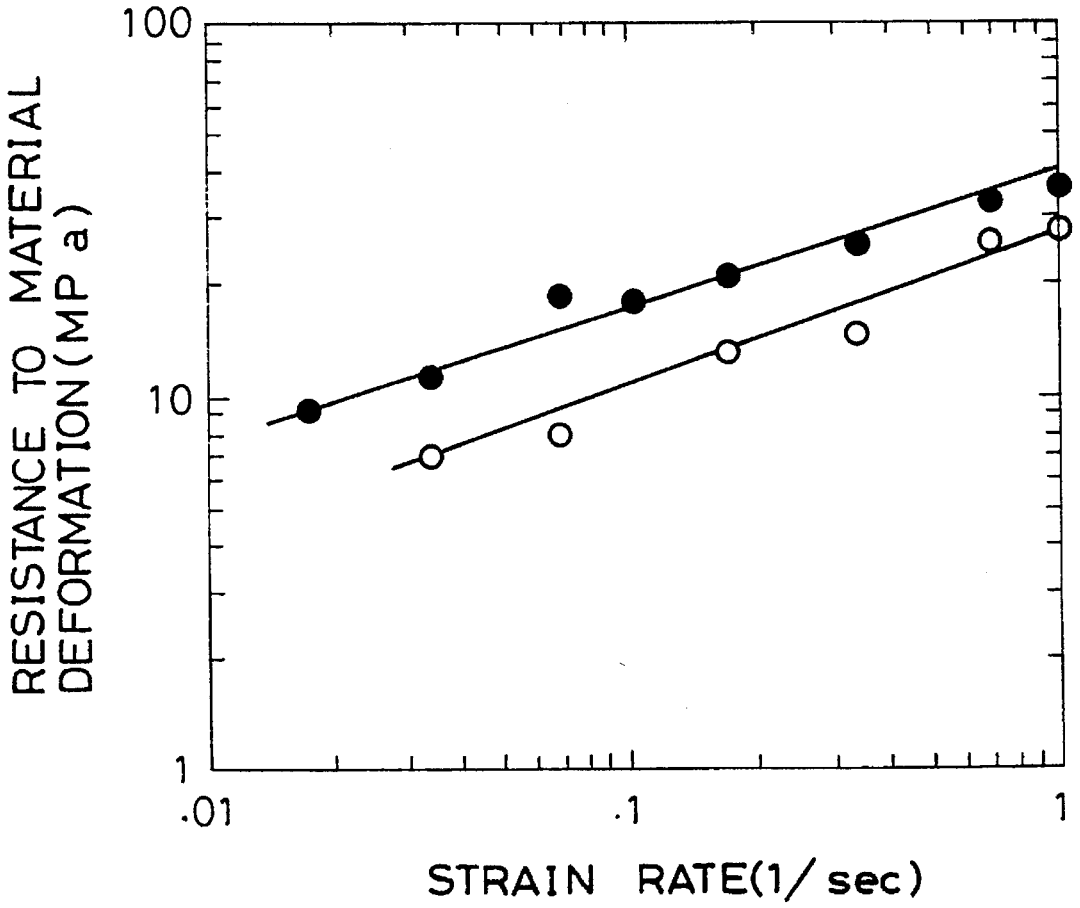
FIG. 1 is a diagram showing the relation between the strain rate and the resistance of material deformation obtained in a tensile test performed on a superplastic Mg-based composite material of this invention produced as indicated in a working example.

First, the background of the invention will now be described.

Materials which can be effectively used for reinforcing magnesium-based composite materials include silicon carbide (SIC) and silicon nitride ($Si_3N_4$) whiskers or particles, titanium carbide (TIC) particles, alumina ($Al_2O_3$) particles, aluminum nitride (AlN) particles, and titanium boride ($TiB_2$) particles. These ceramic particles extensively used as structure quality ceramics because they have high modulus of elasticity and strength, exhibit extremely high rigidity and high stability even at elevated temperatures, and-exhibit a high electrical insulating property and a low thermal expansion coefficient. However, the composite materials reinforced with these conventional ceramic particles suffer uneven dispersion of reinforcing particles therein, deficiency in fracture toughness, and inferiority of formability. They are able to acquire superplasticity and enjoy improved formability when the dispersability of the reinforcing particles therein is improved.

For such a composite material to manifest superplasticity, however, it is necessary for slip deformation to occur in the phase boundaries between the reinforcing material and the magnesium matrix at the superplasticity temperature. When the slip deformation fails to occur, the composite material sustains cracks along the phase boundaries and manifests no superplasticity. For enabling the composite material to manifest superplasticity, therefore, it is important that the crystal grains of the matrix be so fine as to ensure the occurrence of the slip deformation along the phase boundaries. The TiC, AlN, $Si_3N_4$, or $TiB_2$ particles used in this invention can be expected to exhibit higher chemical stability against magnesium than SiC particles. Therefore, even when the extrusion or rolling is performed at a temperature higher than the solid-phase temperature, little the reaction of TiC, AlN, $Si_3N_4$, or $TiB_2$ particles with the Mg alloy is likely.

The extrusion performed on the composite material having the ceramic particles dispersed in the matrix has some effect toward reducing the diameter of the crystal grains of the magnesium matrix. This effect increases when the extrusion is combined with rolling.

The extrusion has to be carried out at a temperature in the range of from 200° to 500° C. at an extrusion ratio of at least 10:1 and the subsequent rolling has to be carried out at a temperature in the range of from 250° to 550° C. at a distortion rate in the range of from 1.0 to 4.0.

From the practical point of view, the composite material which has ceramic particles dispersed in the magnesium matrix is preferably manufactured by the melt stirring method.

The Al, Zn, Zr, or Li content in the magnesium alloy for use in this invention is practically in the range of from 2 to 15% by weight. The magnesium alloy has a minimum particle diameter in the range of from 100 to 200 microns. This minimum particle diameter is a necessary condition for ensuring the occurrence of the slip deformation along the phase boundaries between the alloy and the ceramic particles serving as the reinforcing material. Extrusion alone does not bring about uniform dispersion of the ceramic particles in the matrix. When extrusion is combined with rolling, the dispersion of ceramic particles becomes uniform, the ceramic particles do not produce any reaction product with the magnesium matrix, and the thermal treatment performed in the process of fabrication enables formation of a phase boundary suitable for superplastic deformation. In the superplastic Mg-based composite material of this invention, therefore, the phase boundary is formed in a half molten state or a liquid-phase state at the superplasticity temperature, with the result that the matrix and the reinforcing particles jointly facilitate the slip deformation. Further, the ceramic particles at an elevated temperature repress the possible coarsening of crystal grains of the matrix and reduce the particle diameter of the crystal grains. These two effects jointly enable the composite material to manifest superplasticity at a heightened speed.

In this invention, it is necessary that the content of ceramic particles, in the composite material be in the range of from 5 to 40%, based on the amount of the composite material. If the content of ceramic particles is smaller than the lower limit of this range, reduction of the matrix particle diameter cannot be attained. If this content is larger than the upper limit of the range, the composite material will sustain numerous fine cracks during rolling and will not easily manifest superplasticity.

The superplastic composite material of this invention, when stretched at a temperature in the range of from 200° to 500° C. at a strain rate in the range of from 0.03 to 1.5 per second, produces a minimum elongation in the range of from 160 to 400%.

Shaping the composite material utilizing its superplasticity is therefore preferably carried out under the conditions just mentioned.

Magnesium is characterized by being lighter than any other metal for practical use, having the same melting point of 650° C. as aluminum, excelling in thermal conductivity similarly to aluminum, and possessing an ideal ability to absorb vibration. Thus, application of magnesium alloys per se is under study in such fields as aircraft, automobiles, OA equipment, and AV devices, where high priority is given to weight reduction.

This invention makes it easy to produce a superplastic Mg-based composite material. The magnesium-based composite material of this invention which is reinforced with a ceramic material enjoys high specific strength and high specific modulus of elasticity, exhibits high resistance to heat and to abrasion, and excels in dimensional stability with respect to heat. It is, therefore, expected to find utility in engine parts for automobiles, brake components for railway cars, and packages for semiconductors, for example.

This invention will now be described more specifically below with reference to a working example.

A bar, 40 mm in diameter, of a Mg-5% Zn composite material reinforced with TiC particles (average TiC particle diameter 2 to 5 μm and particle diameters of Mg 100 to 200 microns) produced by the melt stirring method was extruded at 673° K. at an extrusion ratio of 25:1 to obtain a bar 8 mm in diameter. This bar was rolled repeatedly at 673° K. at a draft ratio equivalent to a distortion rate of not more than about 0.1 to obtain a thin sheet composite material having a thickness of about 1 mm.

This sheet material was subjected to a tensile test at 743K. The relation between the strain rate and the resistance of the material deformation is shown in FIG. 1 and the relation between the total elongation and the strain rate in FIG. 2. In both diagrams, the open circles (o) and the solid circles (●) represent the TiC contents, 20% and 10% by volume, in the material.

In FIG. 1, the symbol "m" stands for the sensitivity index of the strain rate relative to the resistance of material deformation, i.e. the linear gradient indicating the relation between the magnitude of the resistance of the material deformation and the strain rate (variation of resistance of material deformation)/(variation of strain rate). In FIG. 1, m=0.3 occurs for o and m=0.43 for ●.

Since superplasticity is manifested when m exceeds 0.3 [Higashi Kenji, Materia Japan, 34-8 (1995), Yasuhiro Maehara, Terence Langdon, Netsushori, 30-3 (1991)], the marks ○ and ● in FIG. 1 both indicate the occurrence of superplasticity.

Figure 2:
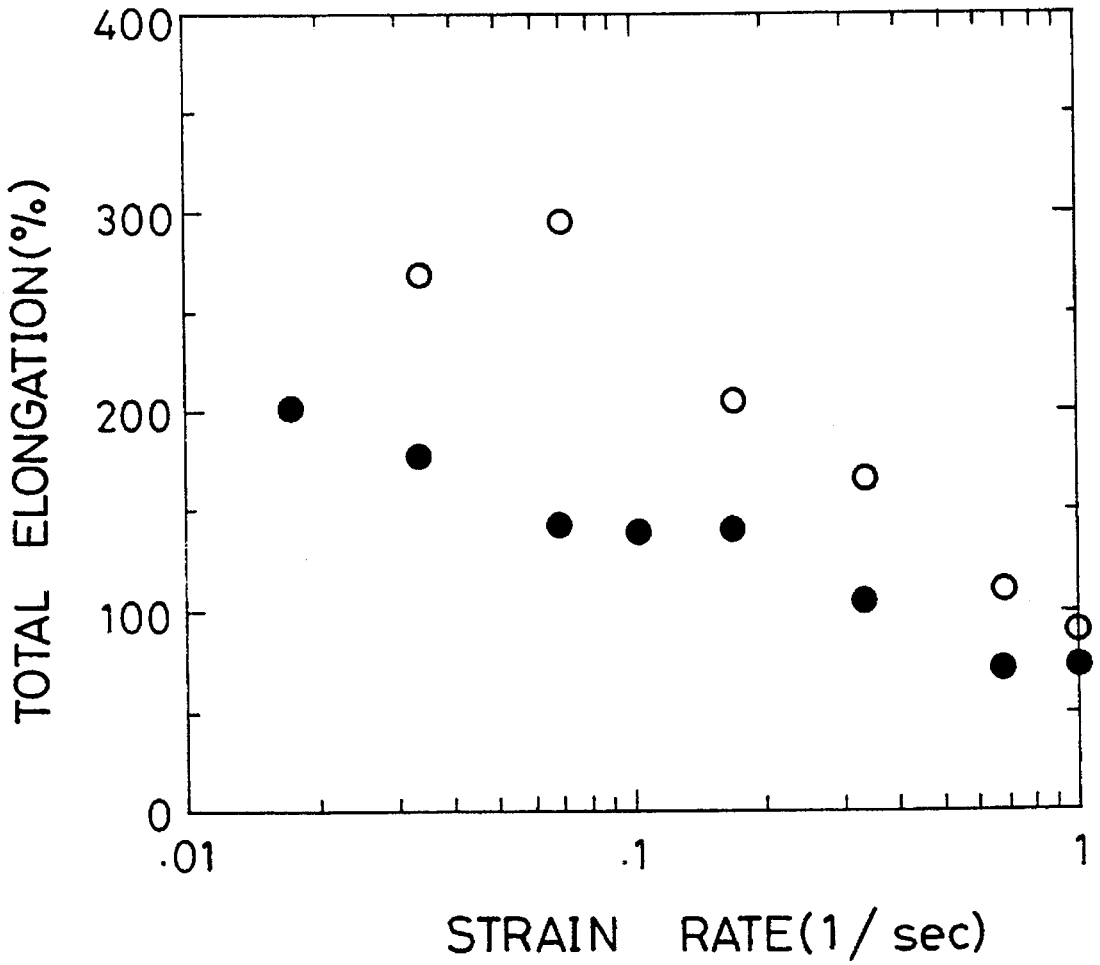
FIG. 2 is a diagram showing the relation between the total elongation and the strain rate obtained in the same test.

In FIG. 2, each open mark (○) represents a total elongation exceeding 300% at a high strain rate of $0.0675^{-1}$ and each solid mark (●) the occurrence of superplasticity, though the magnitude of total elongation is lower than that of the open mark (○).

What is claimed is:

1. A method for the production of a superplastic Mg-based composite material which comprises preparing a composite material consisting of ceramic particles formed of at least one compound selected from among TiC, AlN, $Si_3N_4$, and $TiB_2$ and having a maximum particle diameter of 15 μm and a matrix formed of a magnesium alloy containing at least one element selected from among Al, Zn, Zr, and Li in an amount in the range of from 2 to 15% by weight, said ceramic particles being dispersed in said matrix in the range of from 5 to 40% by volume based on the total volume of said composite material, keeping said composite material at a temperature in the range of from 200° to 500° C. and meanwhile extruding the heated composite material at an extrusion ratio of at least 10:1, and then keeping the resultant extrudate at a temperature in the range of from 250° to 550° C. and meanwhile rolling the heated extrudate at a distortion rate in the range of from 1.0 to 4.0.

2. A superplastic Mg-based composite material produced by a method which comprises preparing a composite material consisting of ceramic particles formed of at least one compound selected from among TiC, AlN, $Si_3N_4$, and $TiB_2$ and having a maximum particle diameter of 15 μm and a matrix formed of a magnesium alloy containing at least one element selected from among Al, Zn, Zr, and Li in an amount in the range of from 2 to 15% by weight, said ceramic particles being dispersed in said matrix in the range of from 5 to 40% by volume based on the total volume of said composite material, keeping said composite material at a temperature in the range of from 200° to 500° C. and meanwhile extruding the heated composite material at an extrusion ratio of at least 10:1, and then keeping the resultant extrudate at a temperature in the range of from 250° to 550° C. and meanwhile rolling the heated extrudate at a distortion rate in the range of from 1.0 to 4.0.

* * * * *